US006298528B1

(12) United States Patent
Workman

(10) Patent No.: US 6,298,528 B1
(45) Date of Patent: Oct. 9, 2001

(54) D-RING WITH GROMMET

(75) Inventor: David Workman, Princeton, NJ (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 09/420,394

(22) Filed: Oct. 18, 1999

(51) Int. Cl.[7] ..... A44B 17/00; F16L 5/00
(52) U.S. Cl. ..... 24/700; 24/265 CD; 24/701
(58) Field of Search ..... 24/700, 701, 197, 24/265 CD, 666, 668

(56) References Cited

U.S. PATENT DOCUMENTS

| | | | | |
|---|---|---|---|---|
| 0,657,683 | * | 9/1900 | Swearingen | 24/701 |
| 1,143,837 | * | 6/1915 | Kozlowski | 24/700 |
| 1,502,316 | | 7/1924 | Mosgrove . | |
| 1,622,735 | | 3/1927 | Noelting et al. . | |
| 2,403,057 | * | 7/1946 | Davis | 24/701 |
| 3,905,526 | | 9/1975 | Tomatsuri . | |
| 4,270,285 | * | 6/1981 | Antonious | 36/50 |
| 4,504,168 | * | 3/1985 | Miller | 24/700 |
| 4,685,173 | * | 8/1987 | Pavur | 16/2 |
| 5,660,423 | | 8/1997 | Herman et al. . | |

* cited by examiner

*Primary Examiner*—Victor N. Sakran
(74) *Attorney, Agent, or Firm*—Baker Botts L.L.P.

(57) ABSTRACT

A D-ring of metal wire is specially shaped to accept and retain a special grommet of a hard, wear-resistant polymeric material. The D-ring has a base leg, a pair of side legs joined to opposite ends of the base leg and converging toward each other from junctures with the base leg, and a substantially arcuate head joined to the side legs at junctures forming a neck opening that is constricted relative to a head opening defined within the head. The grommet is received within the head opening and neck opening of the D-ring and has a hole adapted to receive a hook and a peripheral groove that is in captured engagement with the head of the D-ring and with the junctures of the head and the leg portions. Portions of the groove located at the neck opening of the D-ring are deepened relative to adjacent portions of the groove within the head opening so as to retain the grommet while enabling the grommet to be pressed endwise through the neck opening and into the head opening of the D-ring.

16 Claims, 1 Drawing Sheet

D-RING WITH GROMMET

BACKGROUND OF THE INVENTION

Various luggage items, such as briefcases, tote bags, duffle bags, and garment bags, are often provided with shoulder straps that can be completely detached. Similarly, the lower ends of the shoulder straps of backpacks often can be detached from the lower sides of the backpack body and stowed in a storage pocket. Detachable straps afford the user the option of carrying the luggage item by hand and permit the item to be transported as checked luggage on buses, trains, watercraft and aircraft with the straps stowed, thereby reducing the risk of damage due to the shoulder strap getting caught on conveyor equipment or other articles or objects during handling.

The predominant way of providing for detachment of shoulder straps of luggage items is by D-rings that are affixed to the body of the luggage item and capture hooks that are affixed to the straps. The D-rings are usually made of bent steel wire and the hooks of a cast metal, such as ZAMAC. The hardness of the cast metal hooks is significantly less than that of the steel D-rings, and the difference in hardness results in a high rate of wear of the portion of the hook that engages the D-ring. Over time, the wear produces a notch in the hook, which is a zone of stress concentration and weakness. It is not uncommon for the hook to break at the notch.

BRIEF SUMMARY OF THE INVENTION

An object of the present invention is to completely eliminate the wear of a hook of a relatively softer material that is used with a D-ring of a relatively harder material and thereby prevent weakening and a risk of breakage of the hook.

The foregoing object is attained, in accordance with the present invention, by a D-ring and grommet in which the D-ring is of metal wire and is specially shaped to accept and retain the grommet, which is of a hard, wear-resistant polymeric material. The D-ring has a base leg, a pair of side legs joined to opposite ends of the base leg and converging toward each other from junctures with the base leg, and a substantially arcuate head joined to the side legs at junctures forming a neck opening that is constricted relative to a head opening defined within the head. The grommet is received within the head opening and neck opening of the D-ring, and has a hole adapted to receive a hook and a peripheral groove that is in captured engagement with the head of the D-ring and with the junctures of the head and the leg portions. Portions of the groove located at the neck opening of the D-ring are deepened relative to portions of the groove within the head opening so as to retain the grommet while enabling the grommet to be pressed endwise into the head of the D-ring.

The hardness, wear, and friction properties of the grommet are such as to virtually eliminate wear of the cast metal hook. Moreover, the grommet itself is resistant to wear. The grommet can be manufactured at a relatively low cost and is easy to assemble to the D-ring by being press-fit endwise into the head opening of the D-ring through the neck opening. The grommet is retained in the head opening by the mutual resiliency of the D-ring and the grommet acting at the regions of engagement between the constricted neck portion of the D-ring and the corresponding deepened portions of the groove in the grommet. The endwise press-fitting feature of the D-ring and grommet allows the groove in the grommet to be relatively deep and thus permits the faces of the grommet to overlie the faces of the head of the D-ring and prevent the hook from at any time directly contacting the D-ring. The deep grooves also ensure that the grommet cannot become dislodged from the head of the D-ring. The hole in the grommet captures the hook and prevents the hook from at any time engaging the side legs or base leg of the D-ring. If the grommet becomes dislodged from the head of the D-ring by being pulled out endwise through the neck opening of the D-ring, the user can easily push it back into place. Inasmuch as the load transfer from the hook to the grommet is normally toward the head of the D-ring, the grommet is very unlikely to become dislodged from the neck of the D-ring. In the unlikely event that the grommet is damaged, it can readily be replaced by the user. The capture of the hook in the hole in the grommet and the lack of any metal to metal contact between the hook and the D-ring prevents marring of the finishes of the D-ring and hook.

Preferred embodiments of the D-ring and grommet of the present invention include the following further characteristics:

- The grommet is substantially D-shaped in plan;
- The hole in the grommet is defined by a surface having a convex curvature in cross section;
- The hole in the grommet is round in plan;
- The hole in the grommet is round in plan and is concentric to the head opening of the D-ring;
- The grommet in plan has a substantially semi-circular head portion and a substantially rectangular base portion;
- The grommet is of nylon, such as ST-801 nylon; and
- The groove in cross-section is arcuate and has a radius substantially equal to one-half the diameter of the wire of which the D-ring is formed.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENT

Figure 1:
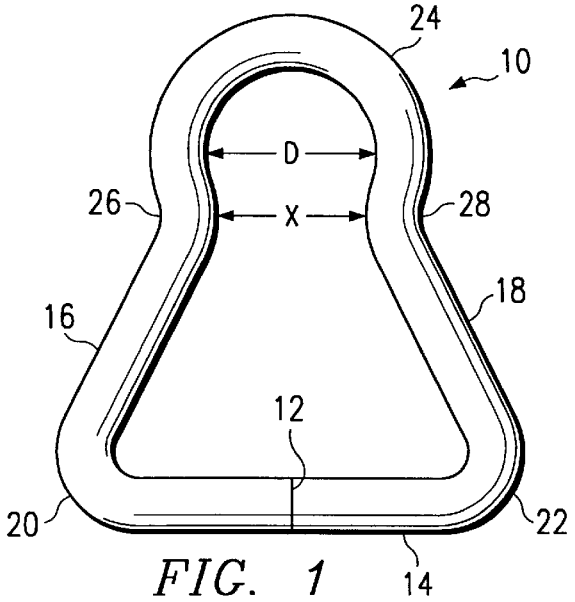
FIG. 1 is an elevational view of one face of the D-ring of the embodiment and is the mirror image of the opposite face.

The D-ring 10 (FIG. 1) is fabricated by bending a length of steel wire stock of a diameter of, for example, 0.150 in. or 0.180 in., to the shape shown and welding the ends at a butt joint 12. The D-ring 10 has a base leg 14, a pair of side legs 16 and 18, which extend upwardly and convergently toward each other from rounded junctures 20 and 22 with the base leg, and an arcuate head 24 that is joined to the side legs at junctures 26 and 28. The spacing X between the junctures 26 and 28 is less than the inner diameter D of the neck, thus forming a neck opening that is constricted relative to a head opening defined within the head 24. The length of the base leg 14 is established by the width of a loop of webbing or leather (not shown) by which the D-ring is attached to the body of a luggage item. D-rings having a different form of base leg for a different form of attachment to the luggage item can be configured with heads and necks similar to that of the illustrated embodiment. The head need not be arcuate but is preferably curved to facilitate shaping it by bending.

Figure 2:
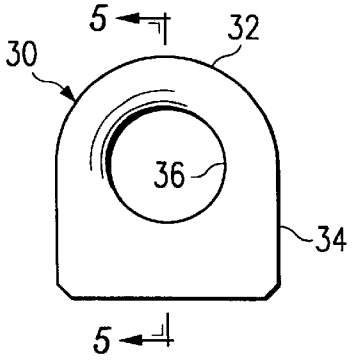
FIG. 2 s an elevational view of one face of the grommet of the embodiment and is the mirror image of the opposite face.
Figure 3:
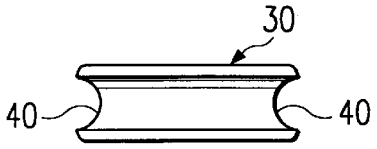
FIG. 3 is a top end view of the grommet of FIG. 2.
Figure 4:
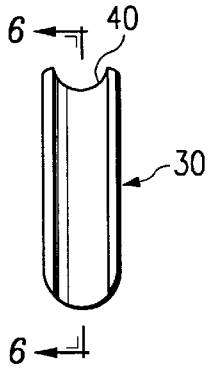
FIG. 4 is a side elevational view of the grommet of FIGS. 2 and 3.
Figure 5:
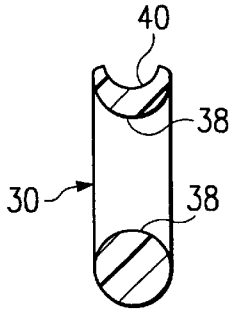
FIG. 5 is a side cross-sectional view of the grommet, taken along the lines 5—5 of FIG. 2.
Figure 6:
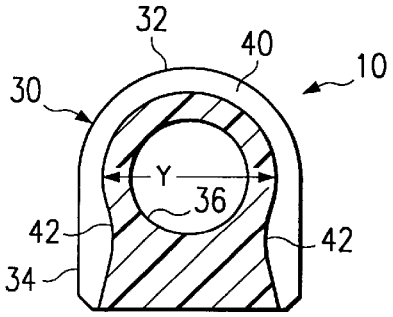
FIG. 6 is a centerline cross-sectional view of the grommet, taken along the lines 6—6 of FIG. 4.

The grommet 30 is molded from a hard, wear-resistant polymeric material, such as nylon, type ST-801 nylon being preferred. Other polymeric materials are possible, provided that they are wear-resistant, hard and have a low coefficient of friction. The objective is to select a material that will not wear the cast metal of the hook with which the D-ring is used. The grommet 30 is generally D-shaped in elevation (FIG. 2), thus having a semi-circular upper portion 32 and a rectangular lower portion 34. A hole 36, which receives the hook (not shown) on a shoulder strap, is concentric with the center of curvature of the upper portion 32 and is defined by a surface 38 of concave shape in cross-section (FIG. 5), thus avoiding any corners in engagement with the hook that would be subject to wear.

Figure 7:
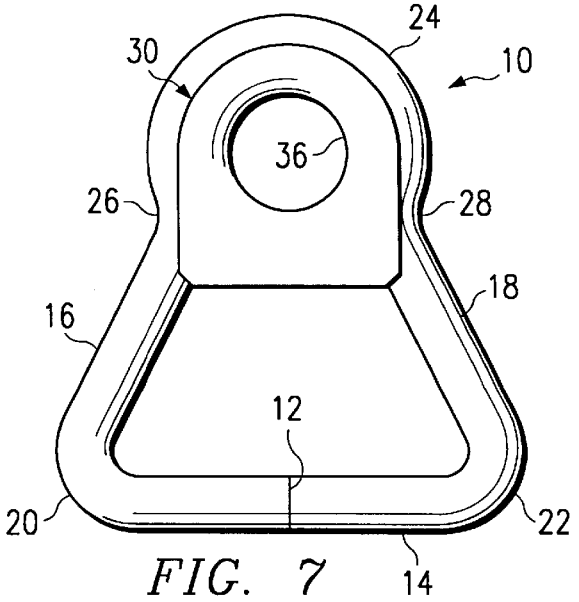
FIG. 7 is an elevational view of one face of the assembled D-ring and grommet and is the mirror image of the other face.

The grommet 30 is captured in the head 24 of the D-ring 10 (FIG. 7). To that end, a continuous groove 40 of arcuate shape in cross section extends along both sides and along the top. The groove 40 has in cross section a radius that closely matches that of the wire of the D-ring and is deep enough to ensure that it cannot readily be dislodged sideways from the head opening of the D-ring. Desirably, the groove extends in cross section through an arc of nearly 180°.

Portions 42 of the groove along each side of the grommet are recessed more deeply into the sides of the grommet than are the portions 44 diametrically opposite each other with respect to the center of curvature of the semicircular portion of the grommet so as to be accepted with an interference fit within the constricted neck opening (at dimension X in FIG. 1) of the D-ring 10 (FIG. 7). For convenience, the portions 42 are referred to herein as "deepened portions". The amount of constriction of the neck opening (dimension X in FIG. 1) of the D-ring with respect to the dimension Y at the base of the groove 40 of the grommet 30 is chosen such that the grommet can be press-fitted endwise into the head portion 24 of the D-ring. Elastic deformation of the grommet and the neck portion of the D-ring allow the grommet to pass through the neck portion of the D-ring into the installed position in the head portion of the D-ring (FIG. 7), whereupon the grommet and D-ring resile at the neck portion of the D-ring with the inner surfaces of the constricted neck portion of the D-ring in interference fit with the deepened portions 42 of the groove 40 of the grommet. Although the grommet can be forced endwise back out of the head 24 of the D-ring, that is unlikely to occur, inasmuch as the loads of the shoulder strap hook on the grommet and D-ring are toward the upper end of the D-ring.

What is claimed is:

1. A D-ring and grommet comprising a D-ring formed of a metal wire and having a base leg, a pair of side legs joined to opposite ends of the base leg and converging toward each other from junctures with the base leg, and a substantially arcuate head joined to the side legs at junctures forming a neck portion that is constricted relative to a head opening defined within the head; and a grommet of a hard wear-resistant polymeric material received within the head opening and neck portion of the D-ring, having a hole adapted to receive a hook, and having a peripheral groove that is in captured engagement with the head of the D-ring and with the junctures of the head and the leg portions, portions of the groove located at the neck opening being deepened relative to portions of the groove within the head opening so as to retain the grommet while enabling the grommet to be pressed endwise into the head of the D-ring.

2. A D-ring and grommet according to claim 1, wherein the grommet is substantially D-shaped in plan.

3. A D-ring and grommet according to claim 1, wherein the hole in the grommet is defined by a surface having a convex curvature in cross section.

4. A D-ring and grommet according to claim 1, wherein the hole in the grommet is round in plan.

5. A D-ring and grommet according to claim 1, wherein the hole in the grommet is round in plan and is concentric to the head opening of the D-ring.

6. A D-ring and grommet according to claim 1, wherein the grommet in plan has a substantially semi-circular head portion and a substantially rectangular base portion.

7. A D-ring and grommet according to claim 1, wherein the grommet is of nylon.

8. A D-ring and grommet according to claim 1, wherein the grommet is a moldment of ST-801 nylon.

9. A D-ring and grommet according to claim 1, wherein the groove in cross section is arcuate and has a radius substantially equal to one-half the diameter of the wire of which the D-ring is formed.

10. A D-ring and grommet comprising a D-ring formed of a metal wire and having a base leg, a pair of side legs joined to opposite ends of the base leg and converging toward each other from junctures with the base leg, and a substantially arcuate head joined to the side legs at junctures forming a neck opening that is constricted relative to a head opening defined within the head; and a grommet of a hard wear-resistant polymeric material received within the head opening and neck opening of the D-ring, the grommet being generally D-shaped in plan and having a round hole that is adapted to receive a hook and is defined by a surface that is arcuate and convex in cross section, and having a peripheral groove that is in captured engagement with the head of the D-ring and with the junctures of the head and the leg portions, portions of the groove located at the neck opening being deepened relative to portions of the groove within the head opening so as to retain the grommet by engagement of the neck portion of the D-ring with the deepened portions of grommet the while enabling the grommet to be pressed endwise into the head of the D-ring.

11. A D-ring and grommet according to claim 10, wherein the hole in the grommet is round in plan.

12. A D-ring and grommet according to claim 10, wherein the hole in the grommet is round in plan and is concentric to the head opening of the D-ring.

13. A D-ring and grommet according to claim 10, wherein the grommet in plan has a substantially semi-circular head portion and a substantially rectangular base portion.

14. A D-ring and grommet according to claim 10, wherein the grommet is of nylon.

15. A D-ring and grommet according to claim 10, wherein the grommet is a moldment of ST-801 nylon.

16. A D-ring and grommet according to claim 10, wherein the groove in cross section is arcuate and has a radius substantially equal to one-half the diameter of the wire of which the D-ring is formed.

* * * * *

UNITED STATES PATENT AND TRADEMARK OFFICE

CERTIFICATE OF CORRECTION

PATENT NO. : 6,298,528 B1
DATED : October 9, 2001
INVENTOR(S) : David Workman

It is certified that error appears in the above-identified patent and that said Letters Patent is hereby corrected as shown below:

Column 1,
Line 4, “duffle” should read -- duffel --

Column 4,
Line 47, “the” (second occurrence) should be deleted

Signed and Sealed this

Twenty-seventh Day of August, 2002

*Attest:*

*Attesting Officer*

JAMES E. ROGAN
*Director of the United States Patent and Trademark Office*